US009938690B2

(12) United States Patent
Terauchi et al.

(10) Patent No.: US 9,938,690 B2
(45) Date of Patent: Apr. 10, 2018

(54) SLEWING TYPE WORKING MACHINE

(71) Applicant: KOBELCO CONSTRUCTION MACHINERY CO., LTD., Hiroshima-shi (JP)

(72) Inventors: Kenichi Terauchi, Hiroshima (JP); Yasutaka Omoto, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 15/377,576

(22) Filed: Dec. 13, 2016

(65) Prior Publication Data

US 2017/0211257 A1 Jul. 27, 2017

(30) Foreign Application Priority Data

Jan. 25, 2016 (JP) ..... 2016-011294

(51) Int. Cl.

| | |
|---|---|
| ***E02F 9/26*** | (2006.01) |
| ***E02F 9/12*** | (2006.01) |
| *E02F 3/32* | (2006.01) |

(52) U.S. Cl.

CPC ..... *E02F 9/126* (2013.01); *E02F 9/123* (2013.01); *E02F 9/26* (2013.01); *E02F 9/267* (2013.01); *E02F 3/32* (2013.01)

(58) Field of Classification Search

None

See application file for complete search history.

(56) References Cited

U.S. PATENT DOCUMENTS 6,324,899 B1 * 12/2001 Discenzo ..... F16C 19/52 340/631

FOREIGN PATENT DOCUMENTS

| | | | | |
|---|---|---|---|---|
| JP | 2001-115490 A | | 4/2001 | |
| JP | 2002-302972 | | 10/2002 | |
| JP | 2013-181345 A | | 9/2013 | |
| JP | 2015-048701 | * | 3/2015 | ..... E02F 9/12 |

OTHER PUBLICATIONS

Extended European Search Report dated May 30, 2017 in European Patent Application No. 16203463.1.

* cited by examiner

*Primary Examiner* — Anna M Momper
*Assistant Examiner* — Ronald P Jarrett
(74) *Attorney, Agent, or Firm* — Oblon, McClelland, Maier & Neustadt, L.L.P.

(57) ABSTRACT

Provided is a working machine capable of accurately detecting a contaminant in grease contained in a slewing mechanism. The working machine includes a lower travelling body, an upper slewing body, and the slewing mechanism. The slewing mechanism includes: a ring gear fixed to the lower travelling body and having inner teeth; a pinion disposed on the upper slewing body and rotated in mesh with the inner teeth of the ring gear; and a grease bath disposed along an inner circumference of the ring gear for storing grease. The upper slewing body includes a sensor for detecting a contaminant having a potential for contaminating and deteriorating the grease, and a sensor supporting member supporting the sensor at a position that allows the sensor to revolve while being immersed in the grease in the grease bath.

6 Claims, 10 Drawing Sheets

SLEWING TYPE WORKING MACHINE

TECHNICAL FIELD

The present invention relates to a working machine such as hydraulic excavator including a lower travelling body and an upper slewing body slewably mounted on the lower travelling body.

BACKGROUND ART

A slewing-type working machine such as hydraulic excavator includes a lower travelling body, an upper slewing body, and a slewing mechanism for slewing the upper slewing body above the lower travelling body. For example, Japanese Unexamined Patent Publication No. 2002-302972 discloses a slewing mechanism that includes a ring gear having a plurality of teeth arranged along an inner circumference thereof and a pinion meshable with the plurality of teeth of the ring gear. The ring gear is fixed to the lower travelling body, and the pinion is supported by the upper slewing body. The pinion is driven by a drive means such as hydraulic motor disposed on the upper slewing body to rotate while meshing with the ring gear. The center of the ring gear coincides with the slewing axis of the upper slewing body. Therefore, the movement of the pinion in a circumferential direction of the ring gear while rotating causes the upper slewing body to be slewed with respect to the lower travelling body.

The slewing mechanism includes a grease bath. The grease bath is shaped in an annular recess extending along the inner circumference of the ring gear, storing grease for lubricating a meshing portion between the ring gear and the pinion. The pinion is supported at a position where a part of the pinion is immersed in the grease in the grease bath. The grease in the grease bath is drawn into the rotating pinion to be supplied to the meshing portion between the pinion and the ring gear.

The grease in the grease bath, however, may be contaminated and deteriorated by water particles having entered the slewing mechanism or by metal powder produced from components of the slewing mechanism. The deteriorated grease is likely to hinder the operation of the slewing mechanism. For example, water particles mixed in the grease in the grease bath significantly reduce the viscosity of the grease while being stirred by the pinion in rotation. The reduction in the viscosity inhibits the grease from sufficiently adhering to the pinion and the ring gear, thus deteriorating the lubrication effect of the grease. This may promote wear and damage of the ring gear and the pinion, hindering the smooth operation of the slewing mechanism. Besides, the water particles having entered the grease bath may be dispersed by the rotating pinion or may splash out from a space between meshed teeth of the ring gear and the pinion. The thus splashed water may then strongly hit a sealed portion of the slewing mechanism and enter a movable portion disposed inside the slewing mechanism to thereby inhibit the slewing mechanism from smooth operation.

To solve the problem, it can be considered to detect a contaminant having a potential for deteriorating the grease in the grease bath to accurately recognize the state of deterioration of the grease, specifically, for example, providing a sensor 70 for detecting a water particle (contaminant) at a bottom portion 20*a* of a grease bath 20, as shown in FIG. 10.

However, even if water particles accumulate on the top surface of the grease G, the grease G filled in the grease bath 20, having a high viscosity, is likely to prevent the water particles from reaching the bottom portion 20*a* of the grease bath 20. Furthermore, a portion of the grease G near the bottom portion 20*a* of the grease bath 20, being hard to stir by a pinion 17, may form a layer of non-deteriorated grease.

For the above reasons, it is difficult to detect a contaminant even though the sensor 70 is disposed at the bottom portion 20*a* of the grease bath 20.

SUMMARY OF INVENTION

The present invention has an object of providing a working machine that includes a slewing mechanism and is capable of accurately detecting a contaminant in grease contained in the slewing mechanism. Provided is a working machine, comprising: a lower travelling body; an upper slewing body mounted on the lower travelling body; and a slewing mechanism for slewing the upper slewing body with respect to the lower slewing body. The slewing mechanism includes a ring gear fixed to the lower travelling body and having a plurality of teeth arranged along an inner circumference thereof, a pinion that is supported by the upper slewing body and is rotated in mesh with the plurality of teeth of the ring gear to thereby slew the upper slewing body, and a grease bath disposed inside the ring gear and extending along the inner circumference of the ring gear, the grease bath storing grease for lubricating a meshing portion between the ring gear and the pinion. The upper slewing body includes at least one sensor for detecting a contaminant having a potential for contaminating the grease to deteriorate it, and a sensor supporting member that supports the at least one sensor at a position that allows the at least one sensor to revolve together with the upper slewing body to slew the upper slewing body while being immersed in the grease in the grease bath.

These and other objects, features and advantages of the present invention will become more apparent upon reading the following detailed description along with the accompanying drawings.

DESCRIPTION OF EMBODIMENTS

As an embodiment of a working machine according to the present invention, there will be described a hydraulic excavator 1 shown in FIG. 1.

Figure 1:
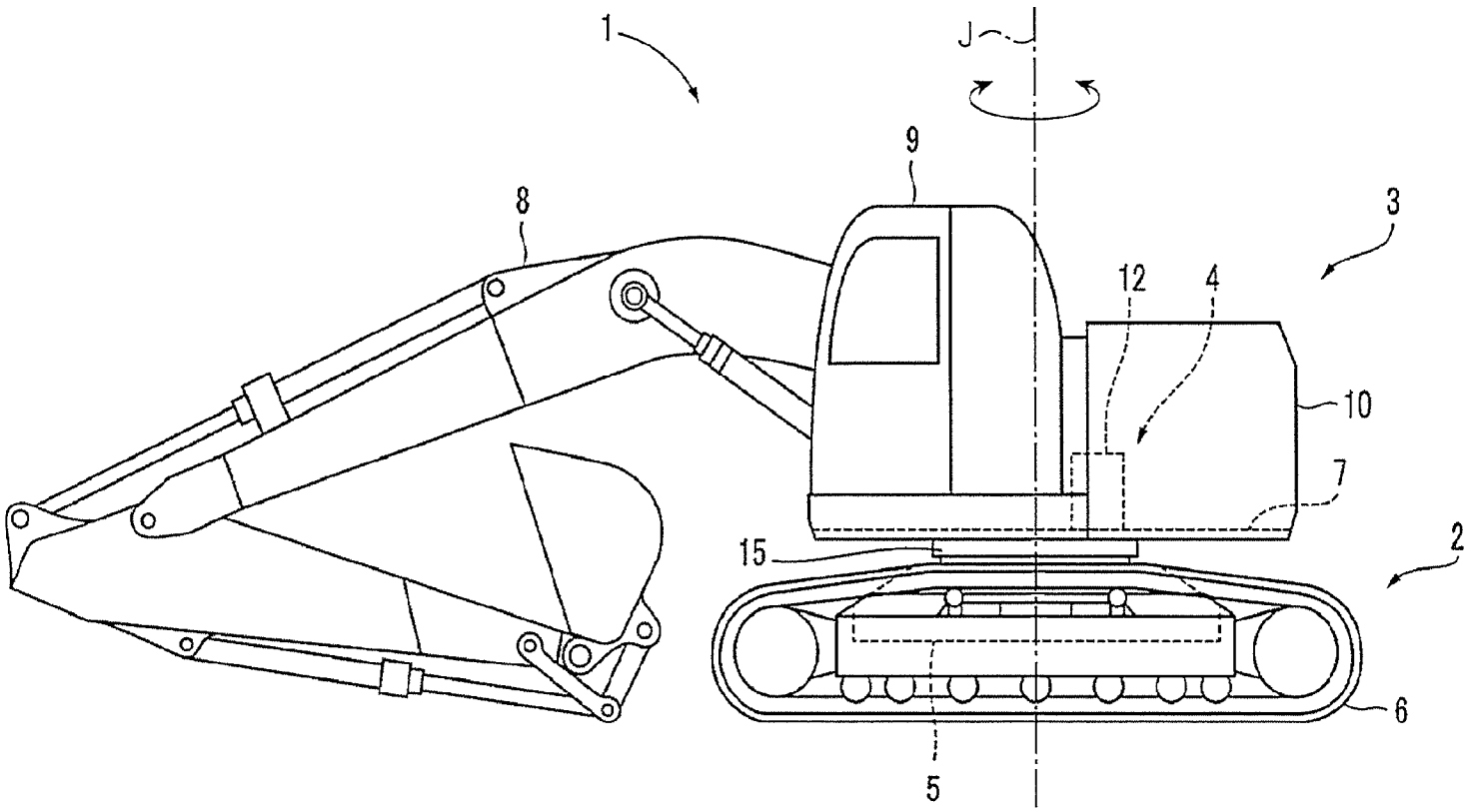
FIG. 1 is a side view showing a working machine according to an embodiment of the present invention.

As shown in FIG. 1, the hydraulic excavator 1 includes a lower travelling body 2, an upper slewing body 3, and a slewing mechanism 4. The lower travelling body 2 and the upper slewing body 3 are interconnected through the slewing mechanism 4 so as to allow the upper slewing body 3 to slew about a slewing axis J with respect to the lower travelling body 2.

The lower travelling body 2 includes a lower frame 5 and a pair of crawlers 6 disposed at opposite ends of the lower frame 5, respectively.

The upper slewing body 3 includes an upper frame 7 and a plurality of components disposed on the upper frame 7, the plurality of components including an attachment 8, a cab 9, and a mechanical chamber 10.

Figure 2:
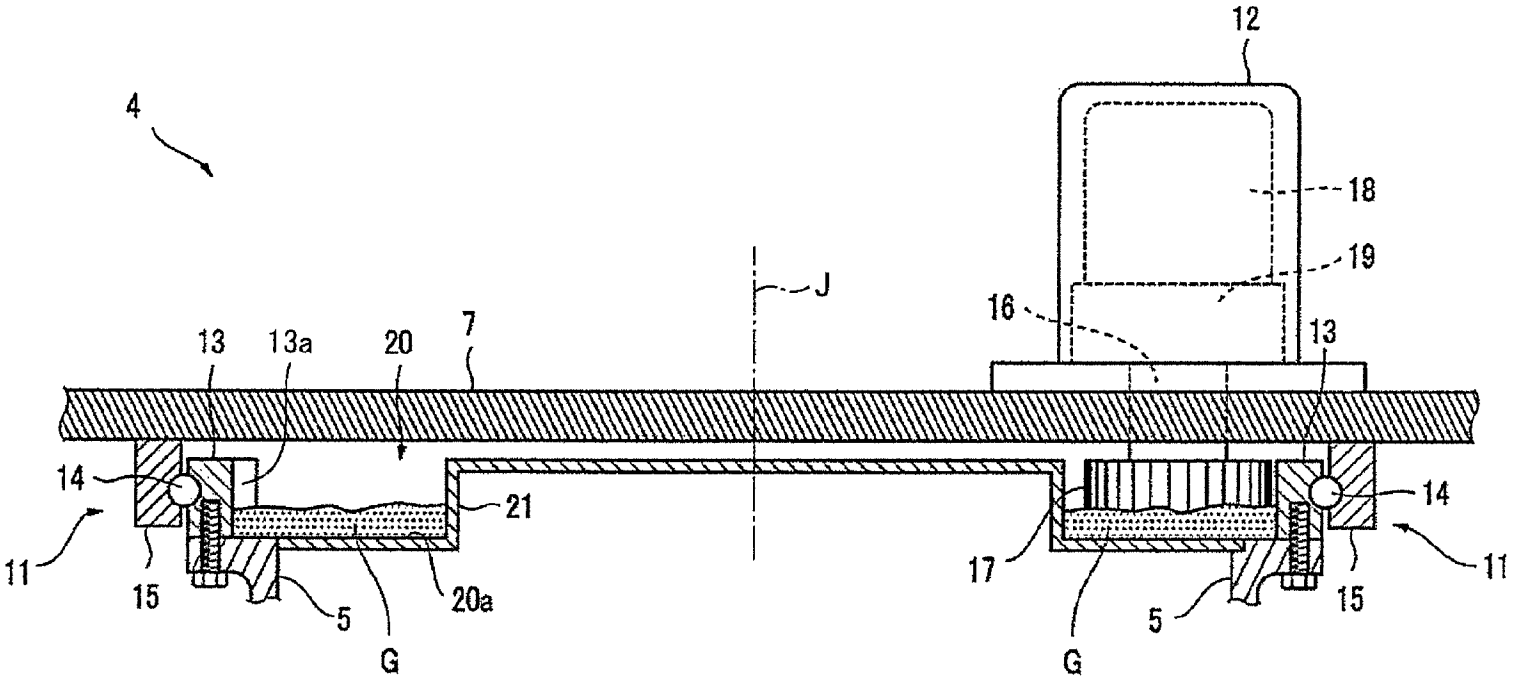
FIG. 2 is a sectional side view showing a slewing mechanism of the working machine.

The slewing mechanism 4 is disposed between the lower frame 5 and the upper frame 7. The slewing mechanism 4 includes, as shown in FIG. 2, a slewing bearing 11 and a driving device 12.

The slewing bearing 11 includes an inner race 13, an outer race 15, and a plurality of steel balls 14 interposed between the outer circumference of the inner race 13 and the inner circumference of the outer race 15 to interconnect the inner and outer races 13 and 15 so as to allow them to be rotated relatively to each other, the slewing bearing 11 being annular with a large diameter. The inner race 13 is fixed to the lower frame 5, whereas the outer race 15 is fixed to the upper frame 7. The inner race 13 includes an inner circumferential surface formed with a plurality of teeth, namely, inner teeth 13A, to configure a ring gear of the present invention.

The driving device 12 includes a drive shaft 16, a pinion 17, a slewing motor 18, and a deceleration mechanism 19. The main body of the driving device 12 is installed on the upper frame 7.

The slewing motor 18 is connected to the drive shaft 16 through the deceleration mechanism 19, and the pinion 17 is fixed to a distal end of the drive shaft 16. The pinion 17 can be rotationally driven together with the drive shaft 16 by the slewing motor 18 in both of forward and reverse directions. The drive shaft 16 extends so as to vertically pass through the upper frame 7 and reach the inside of the inner race 13. The pinion 17 includes a plurality of outer teeth meshable with the inner teeth 13A of the inner race 13. The pinion 17 is rotationally driven by the slewing motor 18 in a state where the outer teeth of the pinion 17 is meshed with inner teeth 13A of the inner race 13, thereby being moved circumferentially of the inner race 13. Specifically, the pinion 17 revolves around the slewing axis J of the upper frame 7 of the upper slewing body 3. The revolution of the pinion 17 involves the slewing of the upper frame 7 of the upper slewing body 3.

Figure 3:
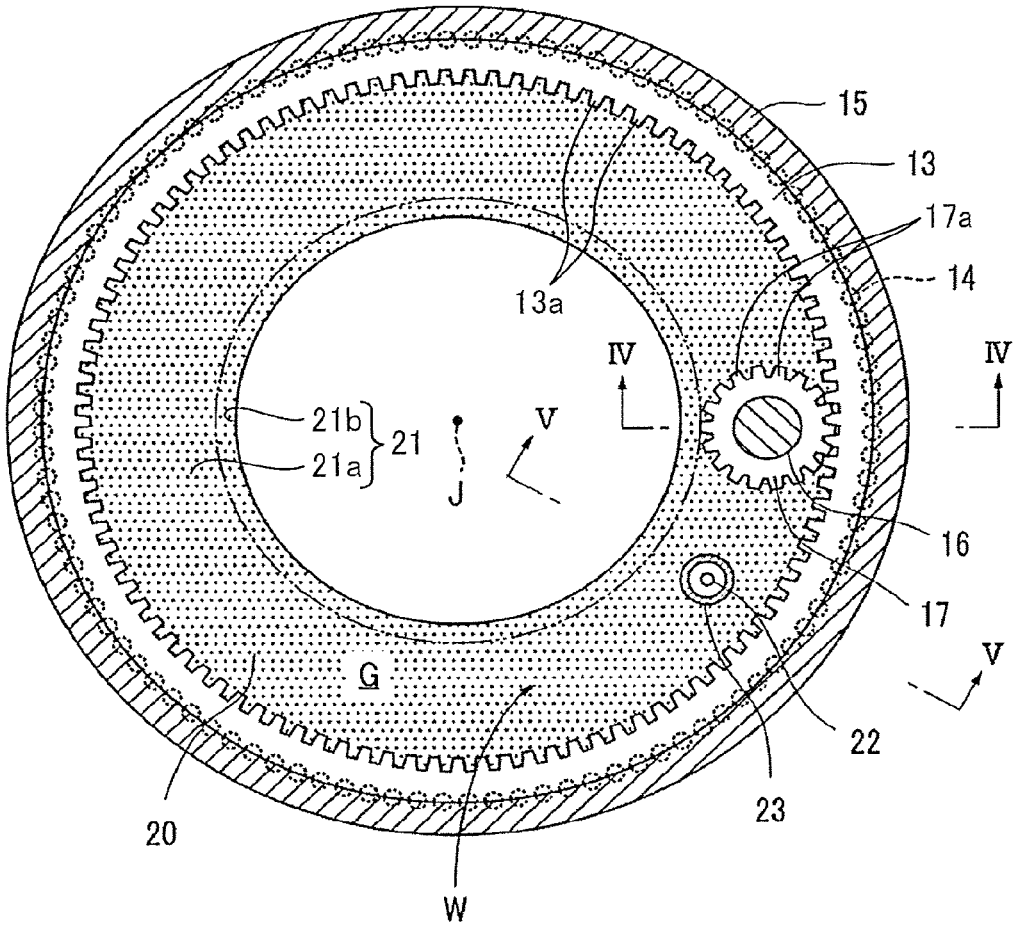
FIG. 3 is a sectional plan view showing an essential part of the slewing mechanism.
Figure 4:
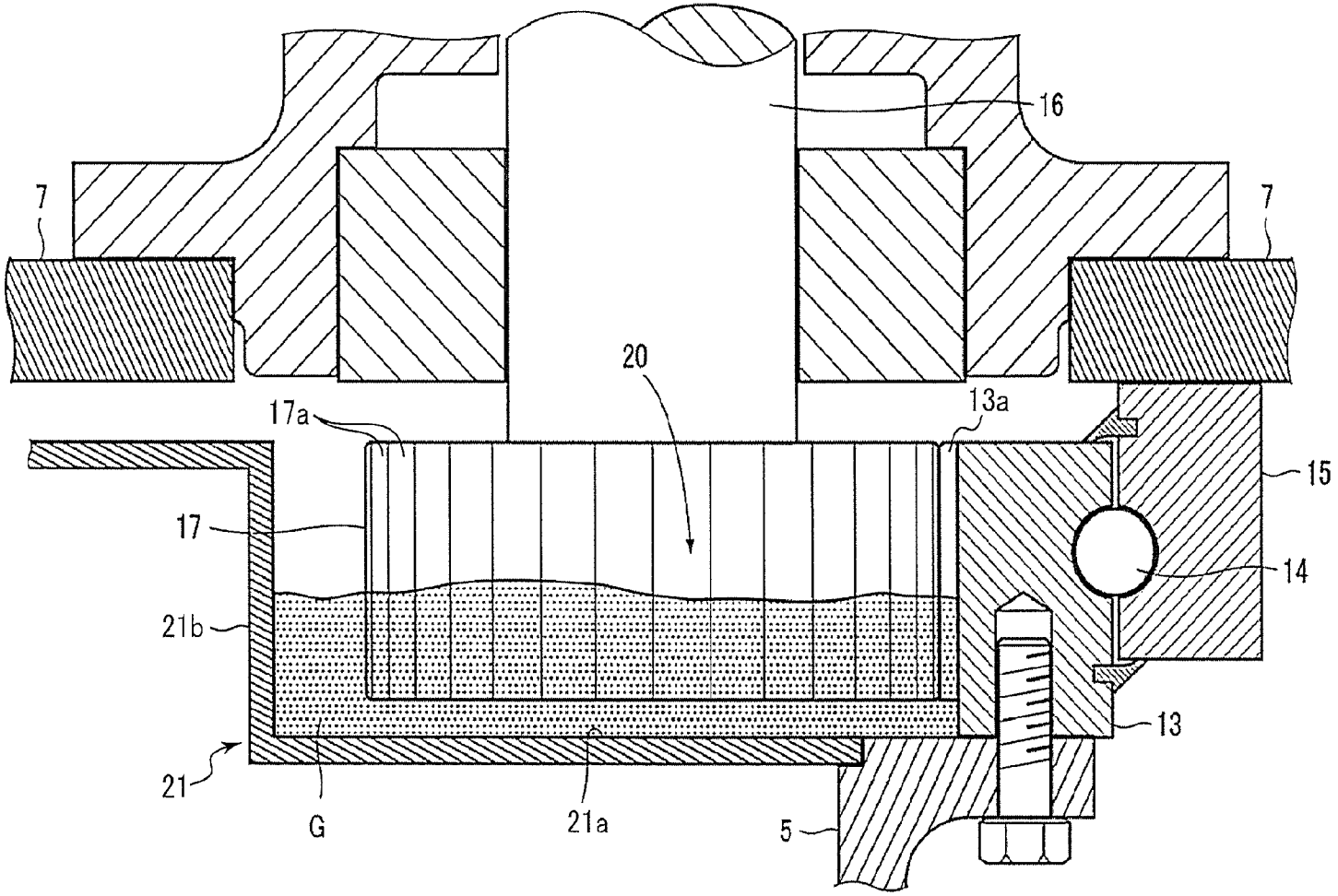
FIG. 4 is a sectional view taken along the line IV-IV of FIG. 3.

The slewing mechanism 4 further includes a grease bath 20 as shown in FIGS. 3 and 4. The grease bath 20 stores grease G for lubricating a meshing portion between the pinion 17 and the ring gear configured by the inner race 13. The grease bath 20 has a shape which is annular in plan view and downward recessed, the shape extending along the inner circumference, that is, being adjacent to the inner circumference, of the inner race 13. The outer circumferential surface of the grease bath 20 is defined by the inner circumferential surface of the inner race 13. To the lower frame 5A is fixed a cover member 21 to cover the inner space enclosed by the inner race 13 on the lower side thereof. The cover member 21 includes a bottom wall 21*a* and an inner circumferential wall 21*b* defining the bottom surface and the inner circumferential surface of the grease bath 20, respectively.

The pinion 17 is disposed in the grease bath 20 in a state where at least the lower half of the pinion 17 is immersed in the grease G. This allows the grease G to enter a meshing portion between the pinion 17 and the ring gear configured by the inner race 13, when the pinion 17 rotates to move in the grease bath 20, to thereby function as a lubricant.

Figure 5:
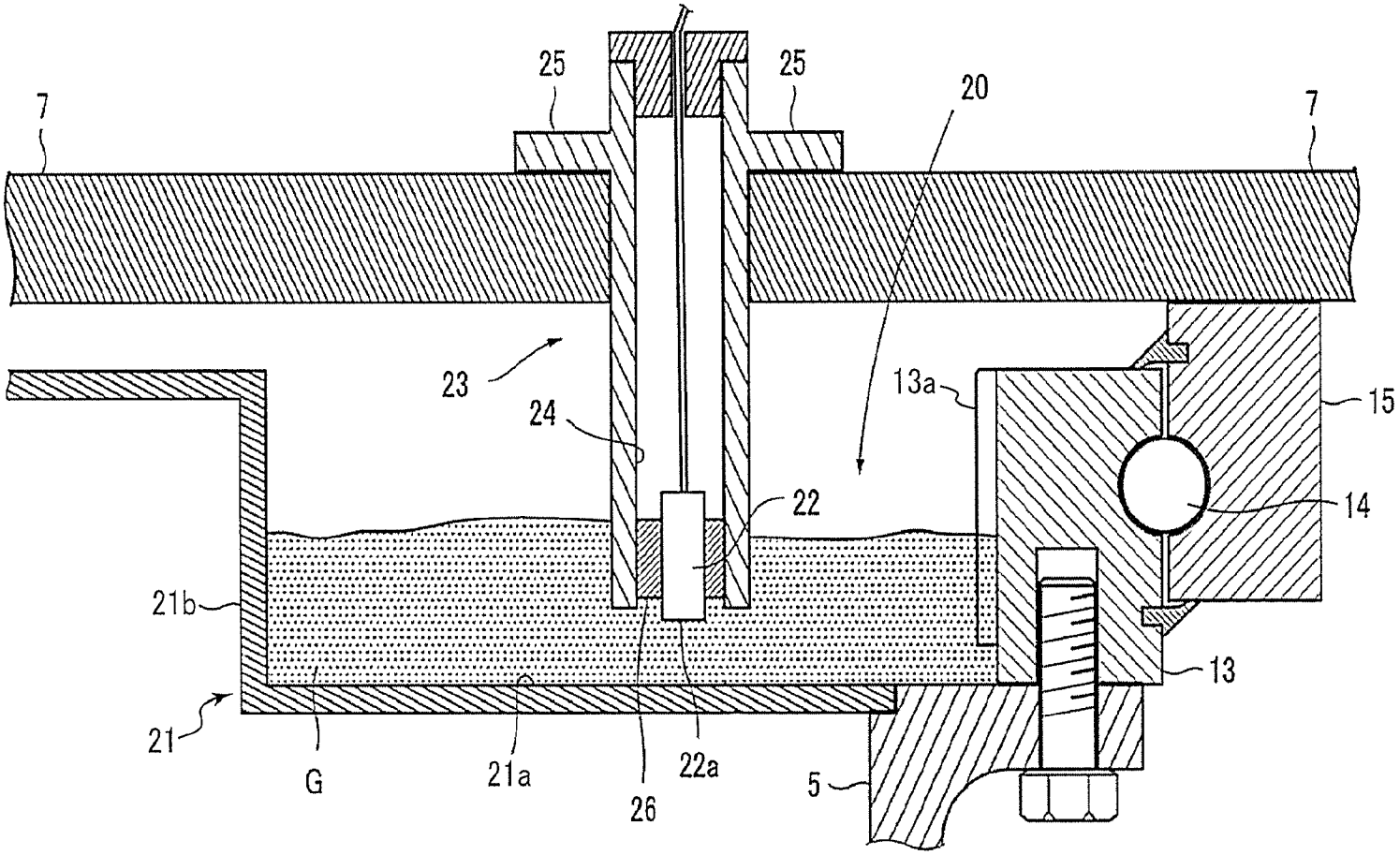
FIG. 5 is a sectional view taken along the line V-V of FIG. 3.

The upper slewing body 3 further includes a sensor 22 shown in FIGS. 3 and 5 and a bracket 23 serving as a sensor supporting member for supporting the sensor 22. The sensor 22 is supported by the upper frame 7 of the upper slewing body 3 through the bracket 23.

The sensor 22 detects a contaminant having a potential for contaminating the grease G in the grease bath 20 to deteriorate it. The sensor 22 includes, for example, a water sensor for detecting a water particle or a metal sensor for detecting metal particle or the like.

The bracket 23 includes a sensor housing 24 and a fixed portion 25 as shown in FIG. 5. The sensor housing 24 has a cylinder shape capable of housing the sensor 22. The fixed portion 25 projects in a flange shape, that is, radially outward beyond the outer circumferential surface of the sensor housing 24. The fixed portion 25 is fixed to the upper frame 7 in a state that the sensor housing 24 vertically passes through the upper frame 7 and the fixed portion 25 makes contact with the top surface of the upper frame 7. The bracket 23 is disposed at a position far from the pinion 17 circumferentially of the upper slewing body 3 within a certain distance.

The sensor 22 includes a detector portion 22*a* in a lower end thereof. The sensor housing 24 of the bracket 23 houses and holds the sensor 22 at such a position that the detector portion 22*a* slightly projects beyond the lower end of the sensor housing 24. A sealing member 26 is loaded between the inner surface of the sensor housing 24 and the body portion of the sensor 22. The sensor housing 24 houses the sensor 22 to thereby minimize contact of the sensor 22 with the grease G while allowing the sensor 22 to reliably detect a contaminant, thus improving the durability of the sensor 22. Specifically, the bracket 23 supports the sensor 22 so that the detector portion 22*a* in the distal end of the sensor 22 is located within a region W (see FIG. 3) of the track of the pinion 17 moving in the grease bath 20 and makes contact with the grease G in the grease bath 20. The region W of the track of the pinion 17 is an area in an annular-band shape having a width equal to the diameter of the pinion 17 and extending along the inner circumference of the inner race 13 in plan view as shown in FIG. 3 (i.e., the area defined between the inner circumference of the inner race 13 and the circle indicated by the two-dot chain line in the grease bath 20 shown in FIG. 3), and is defined between the top surface of the grease Gin the grease bath 20 and the lower end of the pinion 17 as shown in FIG. 5.

The bracket 23 moves in the grease bath 20 in the slewing direction together with the pinion 17 while retaining the detector portion 22*a* at the above-mentioned position. The pinion 17 stirs the grease G to reduce concentration of contaminants in the grease G, thereby allowing the detection accuracy of a contaminant in the grease G to be improved.

Furthermore, the bracket 23 moving in the grease bath while pushing the grease G aside forms a groove in the grease G. The groove corresponds to a track of the movement of the bracket 23 and the detector portion 22*a* exposed below the lower end of the bracket 23. In particular, the bracket 23 contributes to a relatively greatly formed groove. The groove is likely to allow particles of water, which are exemplary contaminants, to be accumulated therein, thus allowing, in the case where the sensor 22 is a water sensor, the detector portion 22*a* of the sensor 22 immersed in the groove to reliably detect the particles of water, namely, the contaminants.

Although the sensor housing 24 of the bracket 23 according to the embodiment houses only the sensor 22, the present invention also permits the sensor housing to house a plurality of sensors for detecting respective different contaminants. Alternatively, it is also possible that the upper slewing body includes a plurality of brackets each including a sensor housing and each of the sensor housing supports a plurality of sensors for detecting respective different contaminants. Besides, the sensor supporting member and the sensor can be integrally formed.

Figure 6:
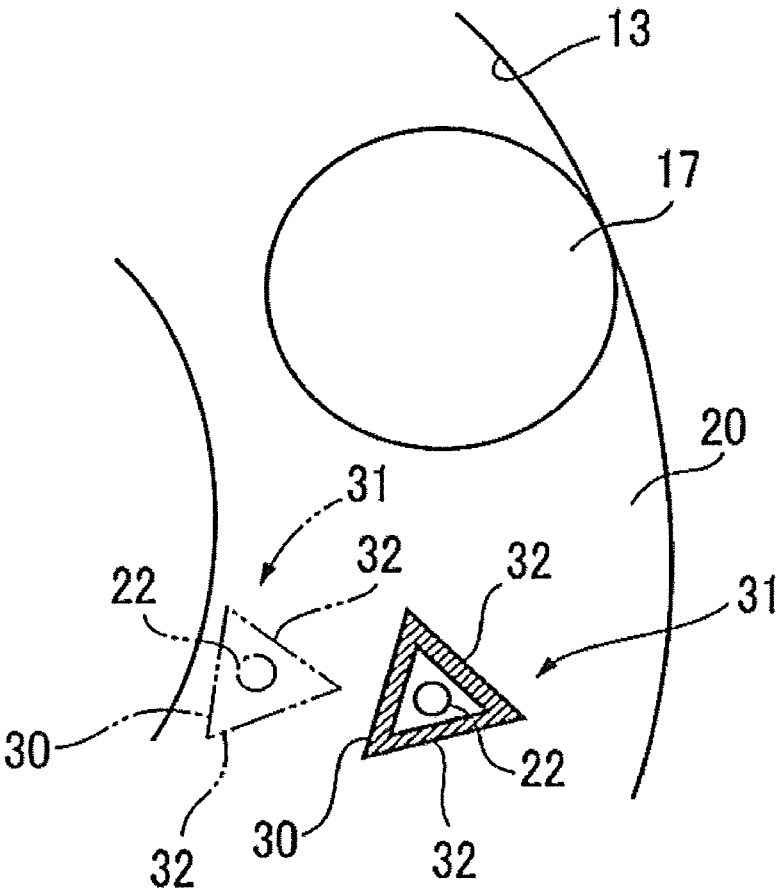
FIG. 6 is a plan view showing a first modification of a bracket of the working machine.

The sensor supporting member is not limited to one including a cylindrical sensor housing such as the sensor housing 24. The sensor supporting member can be, for example, a bracket 31 as shown in FIG. 6 including a sensor housing 30 shaped in a triangular tube to have a plurality of outer surfaces 32. The plurality of outer surfaces 32 of the sensor housing 30 are preferably oblique to a moving direction of the bracket 31 in respective specific directions, which allows the outer surfaces 32 to function as a guide surface. Specifically, the movement of the bracket 13 brings a piece of the grease G into contact with the outer surface 32 of the sensor housing 30, the outer surfaces 32 thereby flowing the piece of the grease G along the outer surfaces 32. The outer surfaces 32, when disposed so as to direct the flow of the piece of the grease G to the inner teeth 13A of the inner race 13, can function as a guide surface for reliably guiding the grease G toward the inner teeth 13A. The grease G thus flowing toward the inner teeth 13A of the inner race 13 is reliably supplied to a meshing portion between the pinion 17 and the inner race 13, i.e., the ring gear.

The outer surfaces 32 of the sensor housing 30, thus functioning as the guide surface, allows the region where the grease G is stirred to be expanded. The flow of the grease G along the outer surfaces 32 are forcibly generated by movement of the bracket 31 and extend to a piece of the grease G, the piece thereof staying at the corners of the grease bath 20 or the like. This makes it possible to reduce the amount of the piece of the grease G staying in the grease bath 20 for a long time.

Thus, the sensor housing 30 of the bracket 31 including a guide surface (in FIG. 6, the outer surfaces 32) enables the grease G, a part of which is likely to stay in the grease bath 20, to be effectively used and further suppresses deterioration of the grease G, thus extending the life of the grease G while.

The bracket 31 alternatively can be disposed at a position close to the inner circumferential surface of the grease bath 20 as indicated by the two-dot chain line in FIG. 6. Since the grease G staying near the inner circumferential surface of the grease bath 20 is often relatively fresh, the outer surfaces 32 of the sensor housing 30 functioning as the guide surface is able to wipe out the grease G which stays near the inner circumferential surface of the grease bath 20 and is relatively fresh to flow it toward the inner teeth 13A of the inner race 13 to thereby supply it to a meshing portion between the pinion 17 and the inner race 13.

Figure 7:
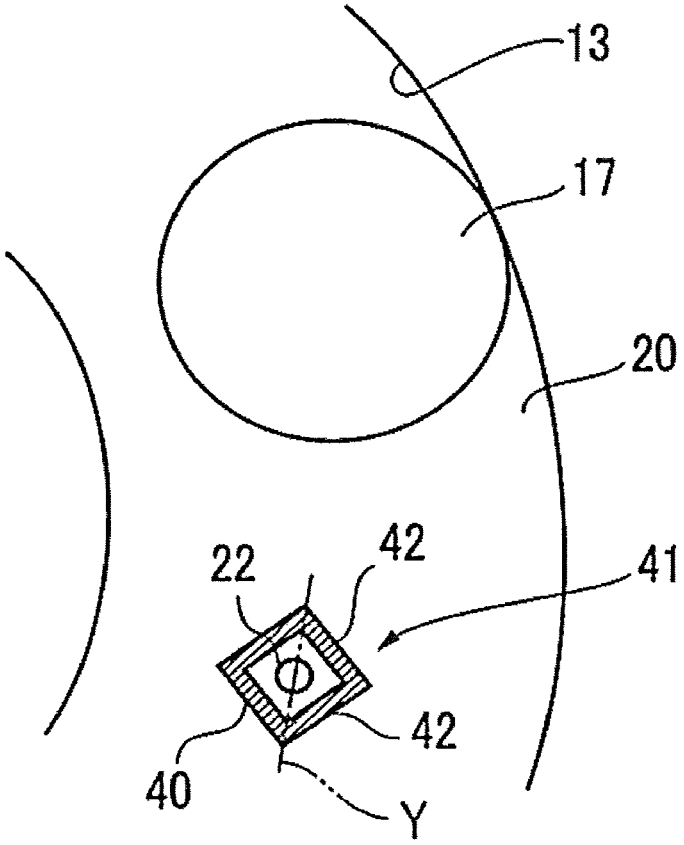
FIG. 7 is a plan view showing a second modification of the bracket of the working machine.

The sensor supporting member alternatively can be a bracket 41 including a sensor housing 40 shaped in a rectangular tube as shown in FIG. 7. The bracket 41, when disposed so as to make a direction along a diagonal line Y of the sensor housing 40 shaped in the rectangular tube substantially coincide with a moving direction of the bracket, can allow each of the four outer surfaces 42 included in the sensor housing 40 to function as a guide surface for the grease G.

Figure 8:
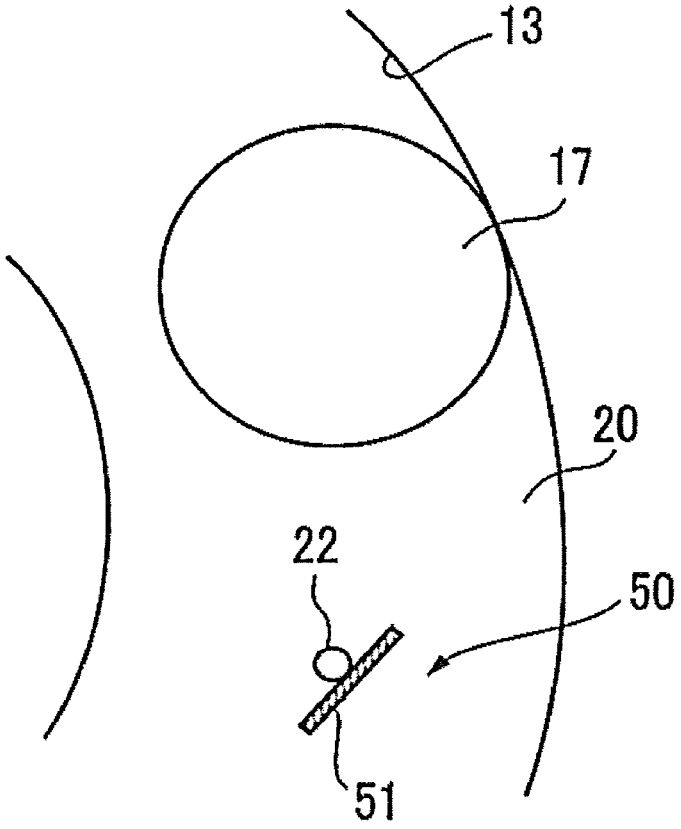
FIGS. 8 is a plan view showing a third modification of the bracket of the working machine.

The sensor supporting member alternatively can be a bracket 50 including a sensor holding portion 51 in the form of a flat plate as shown in FIG. 8. The plate-shaped sensor holding portion 51 holds the sensor 22 secured on a side surface of the sensor holding portion 51. Also the bracket 50, when disposed so as to make the sensor holding portion 51 oblique to a moving direction of the bracket 50, can allow the opposite surfaces of the sensor holding portion 51 to function as a guide surface for the grease G.

Figure 9:
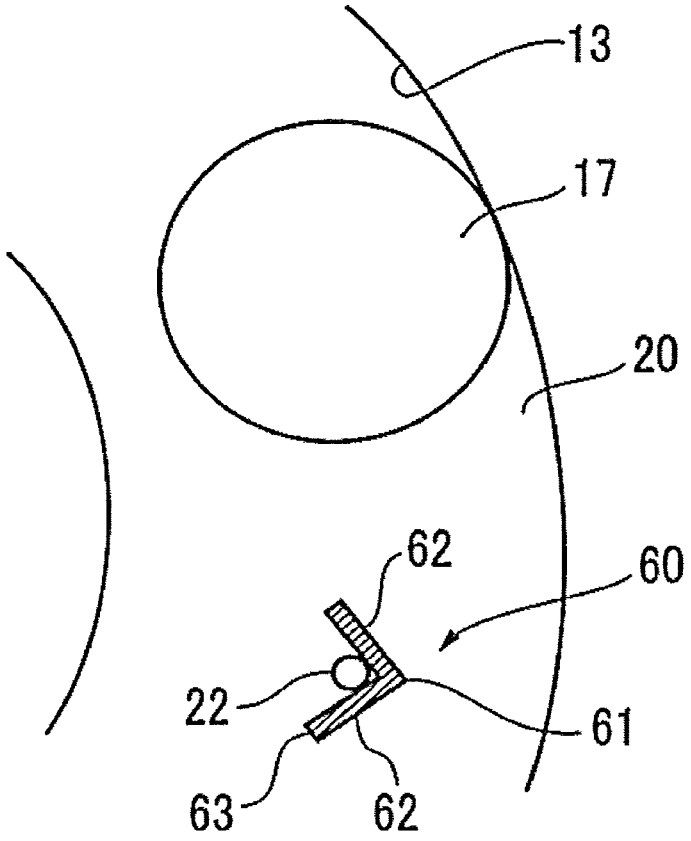
FIG. 9 is a plan view showing a fourth modification of the bracket of the working machine.
Figure 10:
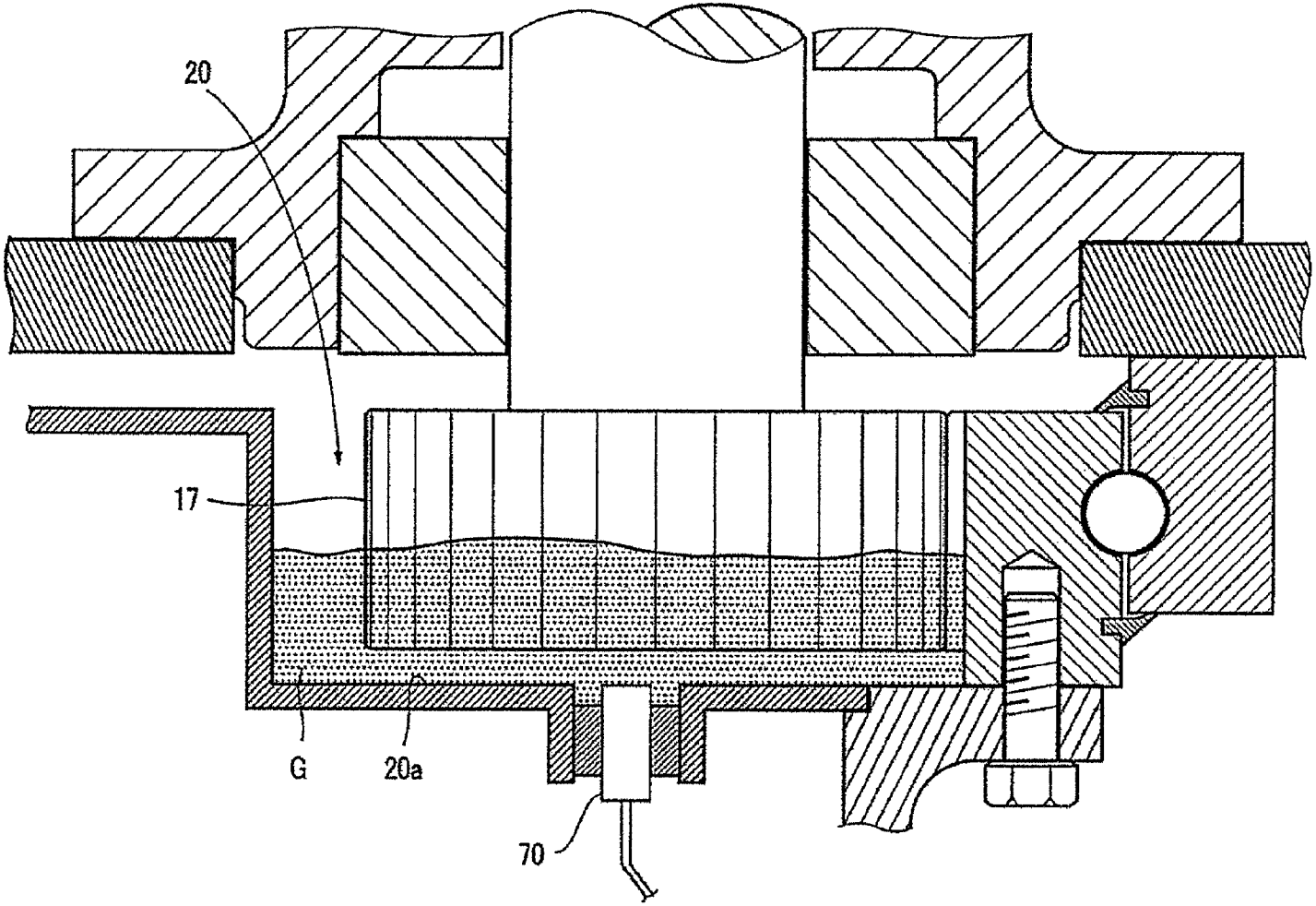
PRIOR ART FIG. 10
FIG. 10 is a sectional view showing a grease bath in a conventional working machine.

The sensor supporting member may be configured as a bracket 60 as shown in FIG. 9. The bracket 60 includes a plate-shaped sensor holding portion 63. The sensor holding portion 63 includes a pair of retention walls 62 joined to each other perpendicularly to define a corner ridge 61 vertically extending between the retention walls 62, retaining the sensor 22 inside the corner ridge 61. The bracket 60, when disposed so as to direct the corner ridge 61 to the inner race 13, can allow the respective outer side surfaces of the retention walls 62 to function as a guide surface for the grease G in movement of the bracket 60.

As described above, the present invention provides a working machine that includes a slewing mechanism and is capable of accurately detecting a contaminant in grease contained in the slewing mechanism. Provided is a working machine, comprising: a lower travelling body; an upper slewing body mounted on the lower travelling body; and a slewing mechanism for slewing the upper slewing body with respect to the lower slewing body. The slewing mechanism includes a ring gear fixed to the lower travelling body and having a plurality of teeth arranged along an inner circumference thereof, a pinion that is supported by the upper slewing body and is rotated in mesh with the plurality of teeth of the ring gear to thereby slew the upper slewing body, and a grease bath disposed inside the ring gear and extending along the inner circumference of the ring gear, the grease bath storing grease for lubricating a meshing portion between the ring gear and the pinion. The upper slewing body includes at least one sensor for detecting a contaminant having a potential for contaminating the grease to deteriorate it, and a sensor supporting member that supports the at least one sensor at a position that allows the at least one sensor to revolve together with the upper slewing body to slew the upper slewing body while being immersed in the grease in the grease bath.

In this working machine, the at least one sensor included in the upper slewing body and the sensor supporting member supporting the at least one sensor move inside the ring gear together with the pinion involved by the slewing of the upper slewing body. During the movement, the sensor which is supported by the sensor supporting portion while immersed in the grease in the grease bath can accurately detect a contaminant in the grease by the contact with the grease during the movement.

The at least one sensor only has to be capable of detecting a contaminant having a potential for contaminating the grease to deteriorate it. Sensors to be used vary among contaminants to be detected. For example, the at least on sensor preferably includes a water sensor for detecting a water particle, a metal sensor for detecting a metal particle a piece of metal and/or the like.

The sensor supporting member can be configured either to support a single sensor or to support a plurality of sensors which detect respective different contaminants. Alternatively, it is also possible that the upper slewing body includes a plurality of sensor supporting members each supporting a plurality of sensors detecting respective different contaminants. The sensor supporting member and the sensor may be integrally formed.

The sensor support member is preferably disposed so as to immerse at least a part of the sensor supporting member in the grease in the grease bath. The thus disposed sensor supporting member, when moving in the grease bath, can form a great groove corresponding to the sensor supporting member to thereby facilitate aggregation of water particles in the groove. This allows, in the case where the at least one sensor includes a water sensor for detecting a water particle, the water sensor to more reliably detect water particles aggregating in the groove. Besides, since the groove corresponds to the track of the sensor supporting member, the size of the groove can be adjusted by the shape of the sensor supporting member.

The sensor supporting member preferably includes, for example, a cylindrical sensor housing that houses the at least one sensor so as to allow the at least one sensor to detect the contaminant. Housing the sensor, the sensor housing restrains the sensor from contact with the grease when the sensor moves in the grease bath, thereby allowing the sensor to maintain its high performance for a long period of time.

It is preferred that the sensor supporting member moves along the inner circumference of the ring gear, together with the pinion while supporting the at least one sensor at a position where the sensor makes contact with the grease in the grease bath within a region of a track of the pinion that moves in the grease bath and along the ring gear. The pinion, rotating with movement in the grease bath, stirs a portion of the grease contained in the track of the pinion. This allows the grease having been already stirred to come into contact with the sensor moving within the region of the track of the pinion. This makes it possible to increase opportunities for a contaminant mixed in the grease to come into contact with the sensor to thereby improve the contaminant detection accuracy.

It is preferred that the sensor supporting member includes a guide surface which flows a piece of the grease, the piece thereof coming into contact with the sensor supporting member when the sensor supporting member moves in the grease bath, toward the teeth of the ring gear. The guide of the grease in the grease bath by the guide surface allows the grease to be smoothly supplied to a meshing portion between the ring gear and the pinion to reliably exert its function of lubricating the meshing portion. Furthermore, the guide surface, forcibly generating the flow of the grease with movement of the sensor supporting member, allows the region where the grease is stirred to be expanded, thus reducing the amount of the piece of the grease, the piece staying in the grease bath for a long time, to allow the efficient use of the grease.

This application is based on Japanese Patent Application No. 2016-011294 filed in Japan Patent Office on Jan. 25, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A working machine, comprising:

a lower travelling body;

an upper slewing body mounted on the lower travelling body; and a slewing mechanism for slewing the upper slewing body with respect to the lower slewing body, wherein:

the slewing mechanism includes a ring gear fixed to the lower travelling body and having a plurality of teeth arranged along an inner circumference thereof, a pinion that is supported by the upper slewing body and is rotated in mesh with the plurality of teeth of the ring gear to thereby slew the upper slewing body, and a grease bath disposed inside the ring gear and extending along the inner circumference of the ring gear, the grease bath storing grease for lubricating a meshing portion between the ring gear and the pinion; and the upper slewing body includes an upper frame that is disposed over the grease bath and connected to the slewing mechanism to be slewed by the slewing mechanism with respect to the grease bath, at least one sensor for detecting a contaminant having a potential for contaminating the grease to deteriorate the grease, and a sensor support that supports the at least one sensor at a position that allows the at least one sensor to revolve together with the upper slewing body to slew the upper slewing body while the sensor is immersed in the grease in the grease bath, the sensor support including a holding portion that holds the at least one sensor at the position under the upper frame in the grease in the grease bath, and a fixed portion joined to the holding portion and fixed to the upper frame at a position over the grease bath to allow the holding portion holding the at least one sensor to revolve together with the upper frame.

2. The working machine according to claim 1, wherein the sensor support has a part disposed to be immersed in the grease in the grease bath.

3. The working machine according to claim 1, wherein the sensor support includes a cylindrical sensor housing that houses and holds the at least one sensor so as to allow the at least one sensor to detect the contaminant.

4. The working machine according to claim 1, wherein the fixed portion is fixed to the upper frame at a position that allows the sensor support moves along the inner circumference of the ring gear, together with the pinion, while supporting the at least one sensor at a position where the sensor makes contact with the grease in the grease bath within a region of a track of the pinion that moves in the grease bath and along the ring gear.

5. The working machine according to claim 4, wherein the at least one sensor includes a water sensor for detecting a water particle as the contaminant.

6. The working machine according to claim 1, wherein the sensor support includes a guide surface that flows a piece of the grease toward the teeth of the ring gear, the piece of the grease coming into contact with the sensor support involved by movement of the sensor support in the grease bath.

* * * * *